US007753196B2

(12) United States Patent
Cuomo

(10) Patent No.: US 7,753,196 B2
(45) Date of Patent: Jul. 13, 2010

(54) CARRIER AND METHOD

(75) Inventor: Angelo V. Cuomo, Staten Island, NY (US)

(73) Assignee: SJV Food & Beverage Carriers, Inc., Clark, NJ (US)

( * ) Notice: Subject to any disclaimer, the term of this patent is extended or adjusted under 35 U.S.C. 154(b) by 1094 days.

(21) Appl. No.: 11/435,245

(22) Filed: May 15, 2006

(65) Prior Publication Data

US 2006/0201051 A1 Sep. 14, 2006

Related U.S. Application Data

(63) Continuation-in-part of application No. 10/215,938, filed on Aug. 9, 2002, now Pat. No. 7,185,758, and a continuation-in-part of application No. 10/662,265, filed on Sep. 15, 2003, now Pat. No. 7,243,785, and a continuation-in-part of application No. 10/737,612, filed on Dec. 16, 2003, now Pat. No. 7,267,224, and a continuation-in-part of application No. 10/939,264, filed on Sep. 10, 2004, now Pat. No. 7,604,115, and a continuation-in-part of application No. 11/012,440, filed on Dec. 15, 2004, now Pat. No. 7,383,949, and a continuation-in-part of application No. 11/012,789, filed on Dec. 15, 2004, now Pat. No. 7,370,755, and a continuation-in-part of application No. 11/301,913, filed on Dec. 13, 2005, now Pat. No. 7,475,772, and a continuation-in-part of application No. 11/301,407, filed on Dec. 13, 2005, now Pat. No. 7,438,181, and a continuation-in-part of application No. 11/345,898, filed on Feb. 2, 2006.

(51) Int. Cl.
*B65D 75/00* (2006.01)

(52) U.S. Cl. ..... 206/188; 206/162; 206/175; 206/180; 206/193; 206/174; 53/48.1

(58) Field of Classification Search ..... 206/162, 206/175, 188, 190, 180, 427, 139, 193, 170, 206/147, 174, 187; 53/48.1, 458; 229/117.13, 229/117, 117.14; 493/51, 90
See application file for complete search history.

(56) References Cited

U.S. PATENT DOCUMENTS

| | | | | |
|---|---|---|---|---|
| 2,026,525 | A | 1/1936 | Korte | |
| 2,330,699 | A | 9/1943 | Flamm | |
| 2,405,517 | A | 8/1946 | Plummer | |
| 2,594,376 | A | 4/1952 | Arneson | |
| 2,741,399 | A * | 4/1956 | Arneson | 206/171 |
| 2,755,964 | A * | 7/1956 | Ringler | 206/176 |
| 2,850,223 | A | 8/1958 | Strauss | |
| 2,857,077 | A * | 10/1958 | Von Gaa | 206/180 |
| 3,123,213 | A | 3/1964 | Kulig | |

(Continued)

*Primary Examiner*—David T Fidei
(74) *Attorney, Agent, or Firm*—Gregor N. Neff

(57) ABSTRACT

A foldable carrier for beverages and other objects has a pair of folding receptacles extending outwardly from a central vertical support panel structure. Horizontal slits are formed in the side walls across two or four corners of the carrier, and the resulting horizontal strips of material are bent inwardly to form dividers for separating objects from one another in the receptacles. If the slits are positioned just below the upper edges of the side walls, bending the strips inwardly effectively forms compartments of reduced height to facilitate the accommodation of objects of varying height, and/or displaying additional areas of the beverage containers and their labels.

12 Claims, 7 Drawing Sheets

U.S. PATENT DOCUMENTS

| | | | | | |
|---|---|---|---|---|---|
| 3,140,036 | A | | 7/1964 | Spery | |
| 3,191,800 | A | * | 6/1965 | Kowal | 206/179 |
| 3,278,076 | A | * | 10/1966 | Graser | 206/173 |
| 3,576,274 | A | | 4/1971 | Stramaglis | |
| 3,661,417 | A | | 5/1972 | Inman | |
| 3,712,505 | A | * | 1/1973 | Slevin | 206/187 |
| 3,780,906 | A | | 12/1973 | Katzenmeyer | |
| 3,958,744 | A | | 5/1976 | Herglotz | |
| 4,000,813 | A | * | 1/1977 | Stout | 206/187 |
| 4,378,880 | A | * | 4/1983 | Summers | 206/170 |
| 4,610,349 | A | * | 9/1986 | Schwartz et al. | 206/175 |
| 4,620,664 | A | | 11/1986 | Kaufman et al. | |
| 4,969,595 | A | | 11/1990 | Teasdale | |
| 5,052,552 | A | | 10/1991 | Maroszek | |
| 5,320,216 | A | | 6/1994 | Pangborn | |
| 5,337,947 | A | | 8/1994 | Eskandry | |
| 5,458,234 | A | * | 10/1995 | Harris | 206/187 |
| D367,409 | S | | 2/1996 | Hunter | |
| 5,518,110 | A | * | 5/1996 | Harrelson | 206/139 |
| 5,695,051 | A | | 12/1997 | Hart | |
| 5,797,486 | A | | 8/1998 | Picciolo | |
| 5,803,264 | A | | 9/1998 | Gersten et al. | |
| 6,202,836 | B1 | | 3/2001 | Picciolo | |
| 6,321,906 | B1 | * | 11/2001 | Wein | 206/198 |

* cited by examiner

CARRIER AND METHOD

This patent application is a continuation-in-part of U.S. patent application Ser. No. 10/215,938 filed Aug. 9, 2002 now U.S. Pat. No. 7,185,758; Ser. No. 10/662,265, filed Sep. 15, 2003 now U.S. Pat. No. 7,243,785; Ser. No. 10/737,612 filed on Dec. 16, 2003 now U.S. Pat. No. 7,267,224; Ser. No. 10/939,264 filed on Sep. 10, 2004 now U.S. Pat. No. 7,604,115, Ser. No. 11/012,440 filed on Dec. 15, 2004 now U.S. Pat. No. 7,383,949, Ser. No. 11/012,789, filed Dec. 15, 2004 now U.S. Pat. No. 7,370,755, Ser. No. 11/301,913, filed Dec. 13, 2005 now U.S. Pat. No. 7,475,772, Ser. No. 11/301,407, filed Dec. 13, 2005 now U.S. Pat. No. 7,438,181, and Ser. No. 11/345,898, filed Feb. 2, 2006. The disclosure of those patent applications are hereby incorporated herein by reference.

This invention relates to carriers for beverages, food, liquids in containers and other objects, and to methods of making and using such carriers.

In the above-identified prior patent applications are disclosed a number of different general-purpose carriers, and other carriers which are highly advantageous for use in carrying beverages, e.g., in "six packs" of bottles containing soft drinks, beer, etc. Other carriers are specially adapted for use in carrying both beverage cups and solid foods in or from sports arenas, fast-food restaurants, etc.

It is an object of the invention to reduce the cost of manufacturing such carriers by reducing the number of manufacturing steps and/or by increasing the production rate of the carriers.

A further object of the invention is to provide a carrier which provides greater visibility of objects such as beverage container labels in the carriers.

Carriers used for carrying objects of varying size, shape and type, such as food and beverages from a carry-out restaurant, concession stand in a sports stadium, etc., would benefit from making the carriers convertible or adaptable to better hold objects of a variety of heights and shapes.

In accordance with the present invention, the foregoing objects are satisfied by providing a carrier with a vertical support panel structure and two foldable receptacles, each extending outwardly from the lower regions of the vertical support panel structure. A bottom structure unfolds automatically as the carrier blank is unfolded in order to erect the carrier.

The cost of making the carrier is reduced by forming horizontal strips in the corners of the receptacles. The strips can be pushed to fold them inwardly where they serve as dividers to separate objects from one another in the receptacles.

Advantageously, the removal of material from the side walls makes the objects in the receptacles more visible. This gives the opportunity to add an advertising display to the loaded carrier.

The carriers can have walls of varying height if the horizontal strips are cut with the upper edges used as the upper edges of the strips. The strips can be folded inwardly selectively to reduce the side wall height in one or more areas to accommodate both small or larger beverage cups, etc. The same conversion simultaneously forms dividers in the receptacles.

The strips can be folded inwardly by several different procedures.

Some of the strips can be pre-folded inwardly during the folding of the carrier so that they are in place when the carrier is unfolded later for being filled.

Another method is to leave the strips unfolded initially, and then push them or hold them as the carrier is being unfolded, or afterwards, so that the use of the dividers is selective.

When automatic filling equipment is used to fill the carriers, e.g., when they are loaded as six-packs of beverages, it is preferred to pre-fold the strips as much as possible so that a minimum of action is needed to be taken by the filling equipment to unfold the strips. In fact, all that need be done is to position a barrier near certain of the strips as opposed side edges of the folded carrier are pushed towards one another to unfold it.

When the carriers are used to carry take-out food, preferably, the strips are not folded in before hand so that the distributing employee can choose the best position to accommodate the food orders at hand.

In the version of the carrier which can be used conveniently at fast-food outlets to carry both beverages and solid foods, an auxiliary tray can be mounted on the carrier handle to hold said foods over the top of the beverages below, as it is disclosed in the above-identified patent applications.

As with some of the carriers shown in the above-identified patent applications, the vertical support panel structure can be made either with two panels fastened together back-to-back, or with the two panels hinged together so that advertising and/or promotional materials can be located on the inside surfaces of the panels, and the panels can be swung apart to give access to the customer.

The foregoing and other objects and advantages of the invention will be apparent from or set forth in the following description and drawings.

IN THE DRAWINGS

SIX-PACK CARRIER

General Construction

Figure 1:
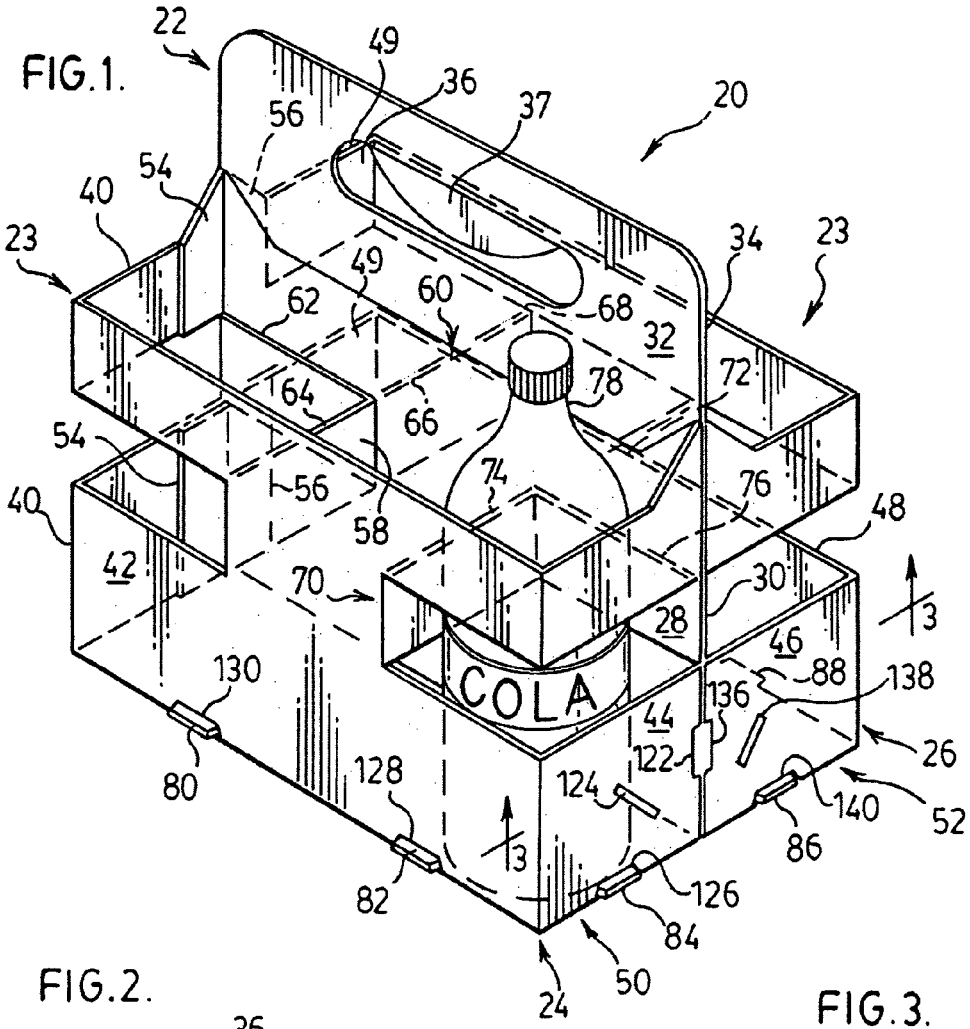
FIG. 1 is a perspective view of one embodiment of a carrier constructed in accordance with the present invention.

FIG. 1 is a perspective view of a six-pack carrier 20 constructed in accordance with the present invention.

The carrier 20 is very similar to the six-pack carriers described in some of the above-identified pending patent applications. It includes a central vertical support panel structure 22 and an external side-wall structure 23 assembled together to form two receptacles 24 and 26, one extending outwardly from each side of the structure 22.

The external side wall structure 23 forming the receptacle 24 comprises a short end wall 40 joined along a fold line to a long side wall 42, with a short side wall 44 secured at one end to the long side wall 42 along a fold line.

Similarly, the external side wall structure 23 forming the receptacle 26 includes a short side wall structure 46 joined along a fold line to a long side wall 48 which, in turn, is joined along a fold line with a short end side wall 49.

Each of the receptacles 24 and 26 has a foldable bottom structure 50 or 52.

In accordance with the present invention, a divider structure is formed by portions of the side wall panels so as to divide each of the two receptacles into three compartments for receiving three beverage containers such as the bottle 78.

Preferably, the divider structures such as 58, 70 are made by slitting the side wall panels to form horizontal strips 62,64 and 74,76 which are folded inwardly, as shown in FIG. 1.

Six-Pack Carrier Blank

Figure 4:
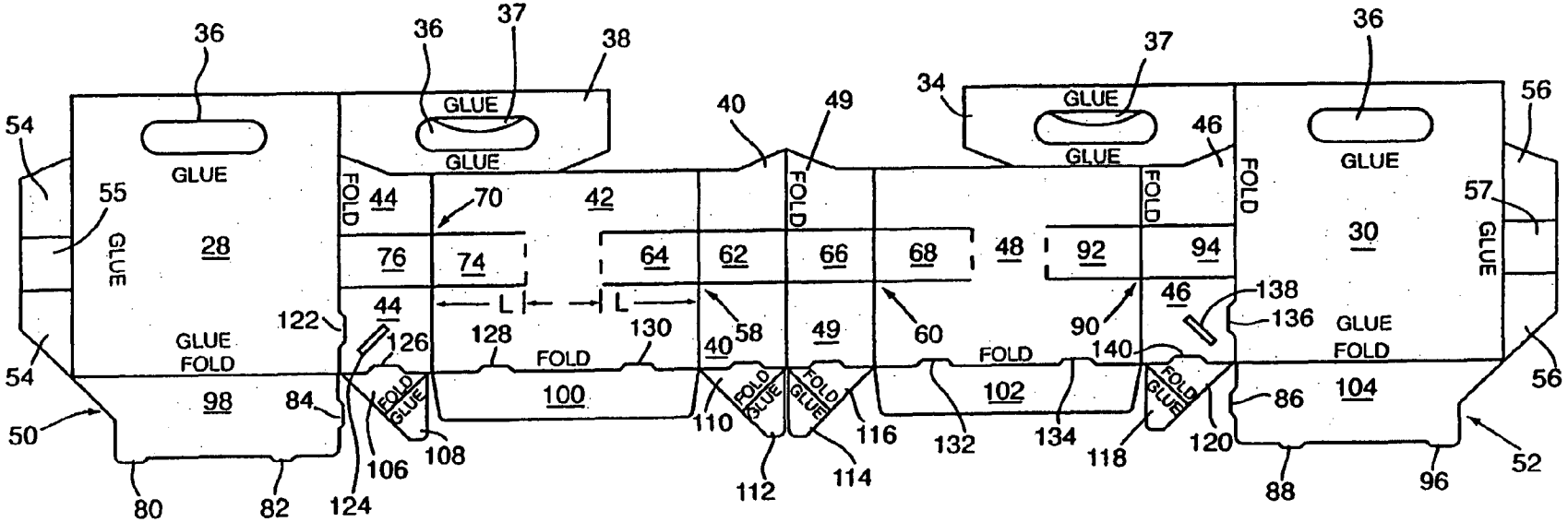
FIG. 4 is a plan view of a blank which is used to make a carrier of the invention.

FIG. 4 shows the blank used to form the carrier 20. In FIG. 4, lines along which folds are made are marked "FOLD", and the other lines shown are lines along which the fiberboard material of the blank is cut, or perforated, as needed.

In general, the carrier 20 and its blank shown in FIG. 4 are the same as the carrier and blanks shown in one or more of the above-identified prior patent applications, except for the divider structure.

Instead of dividers formed from the material of the vertical support panels, the carrier 20 has dividers formed by horizontal strips of material cut from the side walls of the carriers.

The divider structures 58 and 70 are cut as shown in FIG. 4 so that each spans a corner fold line for the carrier. The length "L" of the cut from the corner fold line into the side wall 42 is equal to the distance of the side wall 42 from the vertical support panel 28 when the carrier is fully unfolded so that the innermost part 62 or 76 of the divider structure lies against the vertical support panel 28 when the carrier is unfolded.

The divider structures 60 and 90 for the receptacle 23 are mirror images of the divider structures 58 and 70. The parts 66 and 68 of divider structure 60 and the parts 92 and 94 of divider structure 90 (not shown in FIG. 1) are cut to have the same lengths as the corresponding parts of the divider structures 58 and 70.

Flaps 54 and 56 are provided at the left and right edges, respectively, of the carrier blank to fasten to the side walls 40 and 49, respectively. A section 55 and 57 is formed by two cuts to create tabs in the flaps to fold with the dividers.

As with the carriers shown in the above-identified patent applications, each of the preferred bottom structures 50 and 52 includes four flanges 98, 100, 106 and 110, or 102, 104, 116 and 120, each extending downwardly from the lower edge of one of the side walls and vertical support panel 28 or 30.

Each bottom structure includes a broad flange 98 or 104 secured to a vertical support panel, a narrower flange 100 or 102 secured to the opposite side wall and two shorter triangular flanges 106, 110 or 116, 120. Tabs 108, 112, or 114, 118 are folded over along diagonal fold lines and glue applied, preferably using automated folding and gluing machines so that they are glued to adjacent flaps to provide a smoothly folding and unfolding bottom for each receptacle.

Each of the broad flaps 98 and 104 extends completely across the bottom structure 50 or 52, and has a pair of tabs 80, 82 or, 88, 96 which fit into slots 128, 130 or 132, 134 when the carrier is fully unfolded.

Each broad flap 98 and 104 has another tab 84 or 86 which fits into a vertical slot 122 or 136 when the carrier is folded, and fits into a horizontal slot 126 or 140 when the carrier is fully unfolded.

The flap 84 or 86 fits into a slot 124 or 138 when the carrier is partially unfolded, so as to help hold the receptacle open until articles such as beverages in containers are loaded into the receptacle. Also, the edge of each broad flap from which each tab 84 or 86 extends is positioned to bear against the side wall 44 or 46 to help hold the receptacles open, or to perform the entire task, if needed.

When the blank is folded, the upper handle panels 38 and 34 are glued to the upper portions of the vertical support panels 28 and 30, and the panels 28 and 30 are glued to one another back-to-back to form a four-ply thickness for the handle. The portions 38, 34 are secured to the tops of the side walls 42, 44 and 46, 49 by very weak perforations which break readily when the panels of the carrier are folded.

Unfolding Six-Pack Carrier

Figure 2:
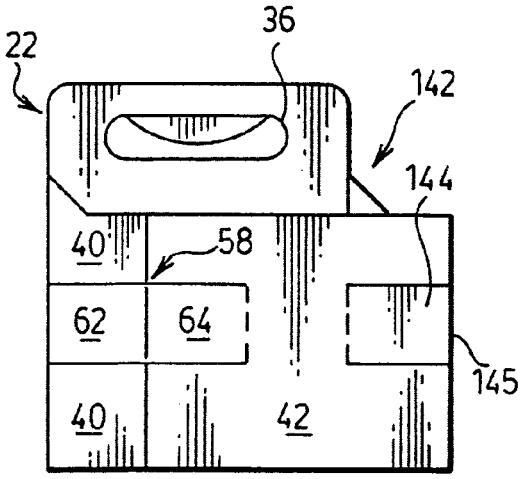
FIG. 2 is a side elevation view of the carrier of FIG. 1, folded flat, in the form in which it is shipped, before it is unfolded at the point of use.

FIG. 2 shows the folded blank 142 in the form in which it is flattened to occupy a minimum of space for packing and shipping to the bottling plant where it is to be unfolded and loaded with beverage bottles or cans.

In folding the carrier, the divider structures 70 and 90 are held in place while the side walls are folded so that the divider structures are folded inwardly when the carrier is folded flat. This leaves a pair of rectangular gaps 144 in the right-hand edge of the folded carrier.

Figure 3:
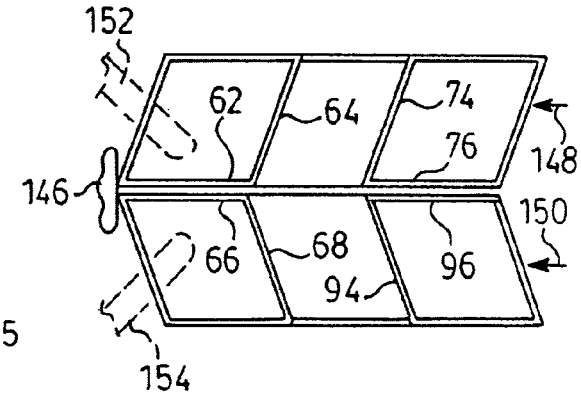
FIG. 3 is a cross-sectional view take along lines 3-3 of FIG. 1, with the carrier only partially unfolded.

Referring now to FIG. 3, when the carrier is unfolded for loading it, the automatic loading equipment presses on the right side edges of the folded carrier in the directions indicated by the arrows 148, 150, while holding the opposite edges, as indicated schematically by the barrier 146. Simultaneously, additional barriers, indicated schematically at 152, 154, hold the inner sections 62 and 66 of the divider structures 58, 60 so that they fold inwardly instead of outwardly.

Thus, all four divider structures are properly positioned to divide the two receptacles into a total of six beverage-receiving compartments.

As it is shown in FIG. 1, the beverage containers in four of the six compartments are more visible and expose at least a portion of the labels of the bottles. This gives an opportunity to create exposure of the brand name, or advertising slogans, etc., in addition to that on the outside of the carrier.

Also, the divider structures shown give the opportunity to reduce the number of glue spots required to construct the carrier. This can speed the manufacture of the carrier and reduce manufacturing costs. Also, the strength of the vertical support structure 22 can be increased and may allow the use of lower cost materials for that structure, without adversely affecting the overall strength of the carrier.

If preferred, the divider structures portions 62, 66 and/or 76 and 96 (see FIG. 3) can be glued to the vertical support structure to avoid the necessity for holding these parts in place during folding or unfolding.

In another variation on the unfolding process, all or some of the divider structures can be left free to fold outwardly as the carrier is unfolded, and then pushed to fold inwardly to their final positions. The folded position of the divider structure 70 is indicated by line 145 in FIG. 2.

Height-Varying Dividers

Figure 5:
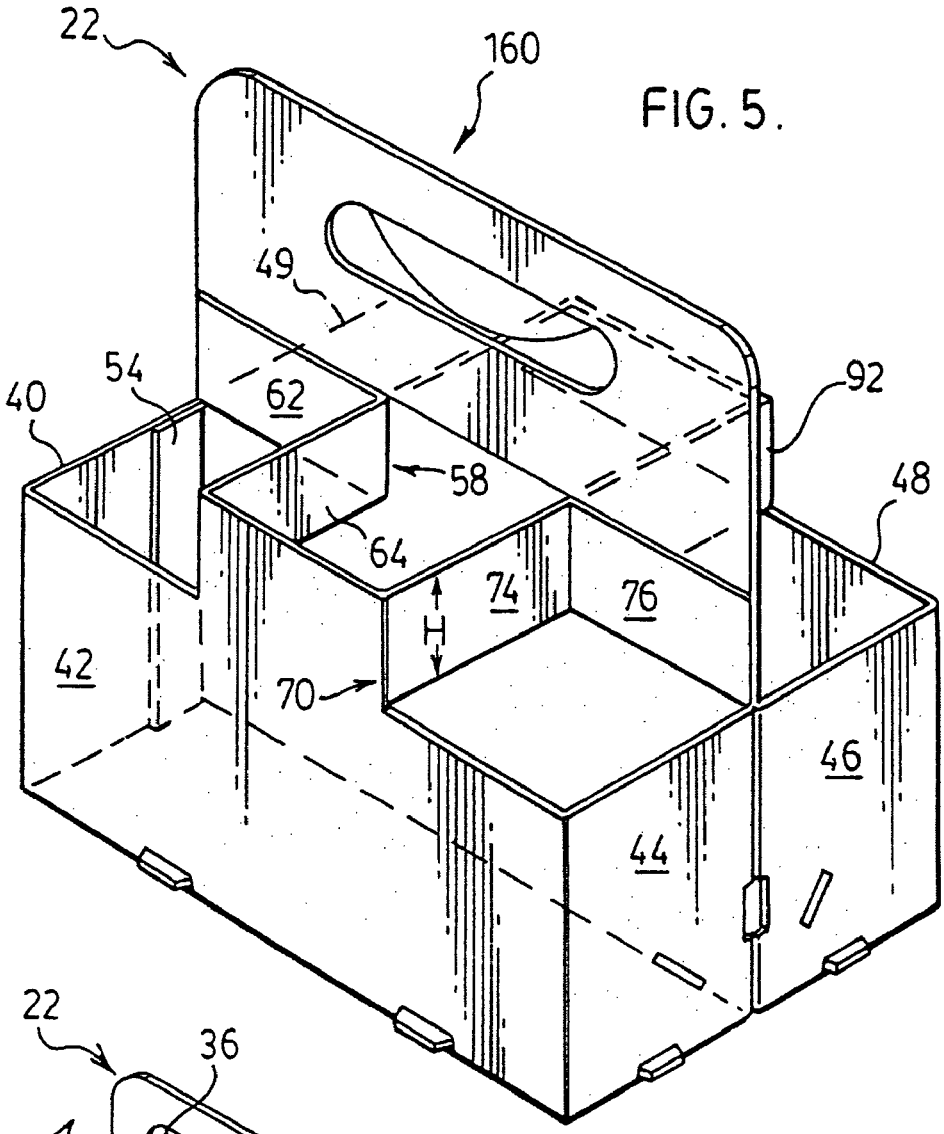
FIGS. 5 and 6 are perspective views of alternative embodiments of the invention.

FIG. 5 shows a carrier 160 of the invention in which the divider structure is used to vary the height or depth of one of more of the compartments of the carrier, while simplifying the manufacture of the carrier.

The carrier 160 is functionally the same as the carrier 20 of FIG. 1 except that the horizontal strips forming the divider structures are formed by making a single cut at a distance "H" below the upper edge of each side wall, thus using the upper edges of the side walls as edges of the divider strips. The gussets at the junctions between the side walls 40, 44, 46 and 49 and the vertical support structure 22 also are eliminated.

This forms four corner compartments of a depth less than that of the two center compartments. This can be useful in forming six-packs of bottles of different heights or in exposing different parts of the containers to view.

Hand-Loaded Carrier

Figure 6:
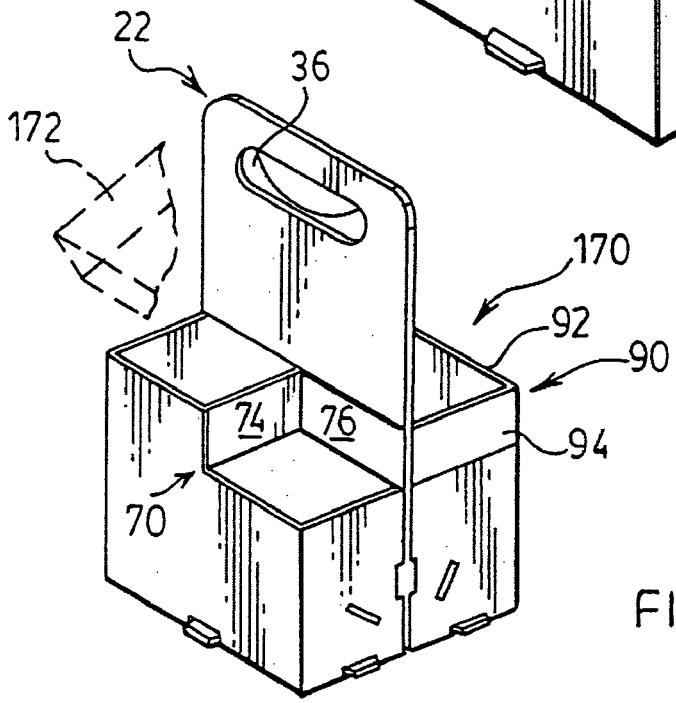

FIG. 6 shows a four-compartment carrier which typically is used for hand-loading such objects as beverage cups of varying size and food objects to be carried away from a concession stand in a sports arena or stadium, or from a fast-food restaurant or the like.

Although the carrier can have six or more compartments, it normally has no more than four, as does the carrier 170 shown in FIG. 6. Only two divider structures 70 and 90 are used. Although, the divider structures can be the same as those shown in FIG. 1, advantageously, they may be of the top-edge type shown in FIG. 5.

Preferably, each of the divider structures is not folded inwardly during manufacture, but is left in the outwardly-extending position as indicated at 145 in FIG. 2.

Then, when the carrier is unfolded at the concession stand or restaurant, the food handler either leaves the divider structures folded out, as is the divider structure 90, or folds the divider structures inwardly, as is the divider structure 70 shown in FIG. 6, so as to divide one receptacle into two compartments and leave the other undivided. Thus, for example, one receptacle can accommodate two beverage cups side-by-side, with a divider to help support them, and the other receptacle can be used to hold food articles, souvenirs, etc., without the imposition of a divider. Of course, both divider structures can be folded in, or can be left folded outwardly, as desired.

If needed, a tray 172 with a slotted bottom (not shown) can be mounted on the handle structure to carry more solid items.

Not only does this embodiment of the invention make the carrier 170 convertible, according to the requirements of each carrying job, but it provides compartments of different depths to facilitate the support and removal of beverage containers of varying heights, such as large and small beverage cups.

Alternative Carriers

Figure 7:
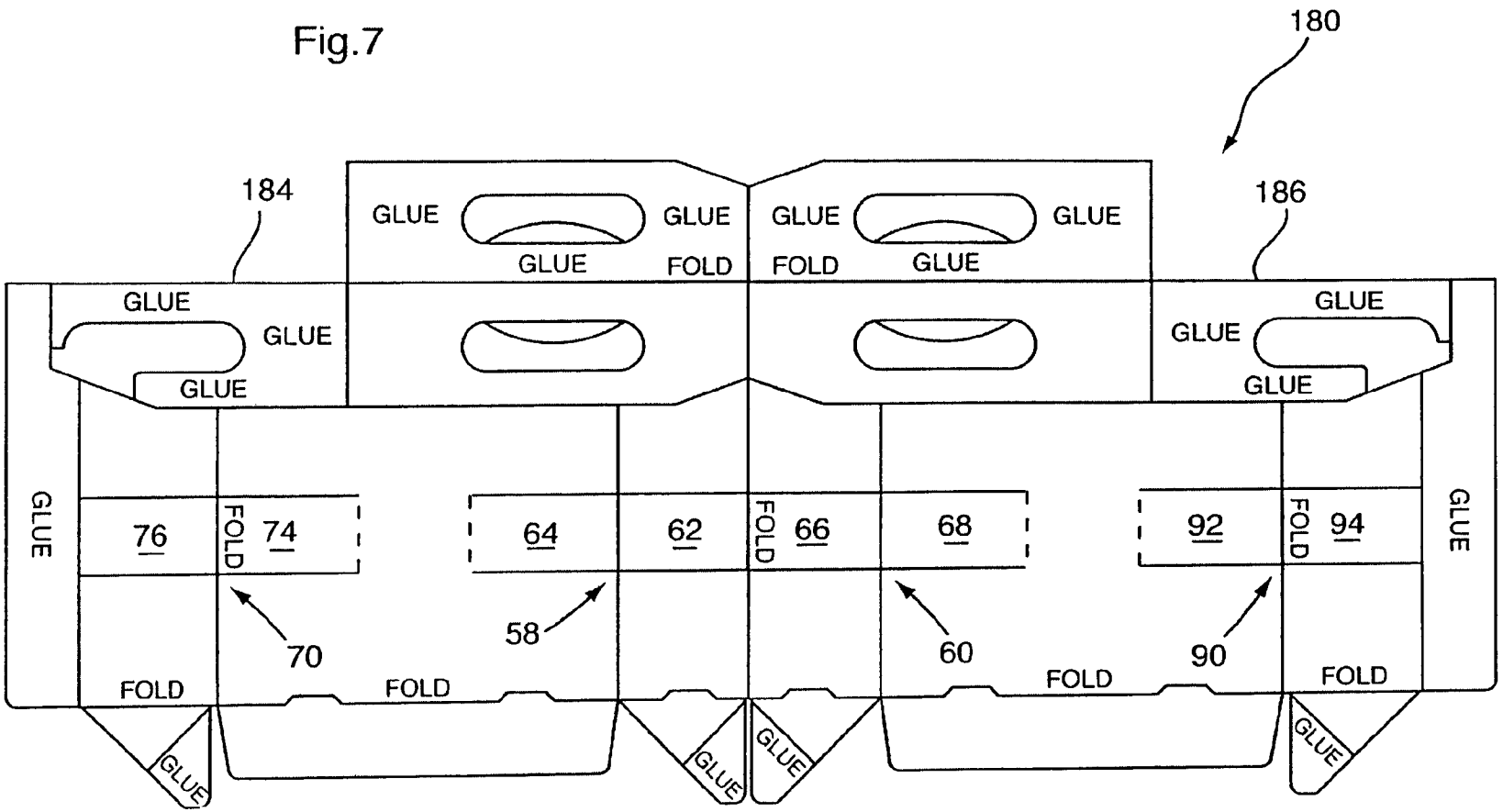
FIGS. 7 through 11 are plan views of blanks used to make other embodiments of the carrier of the invention.
Figure 8:
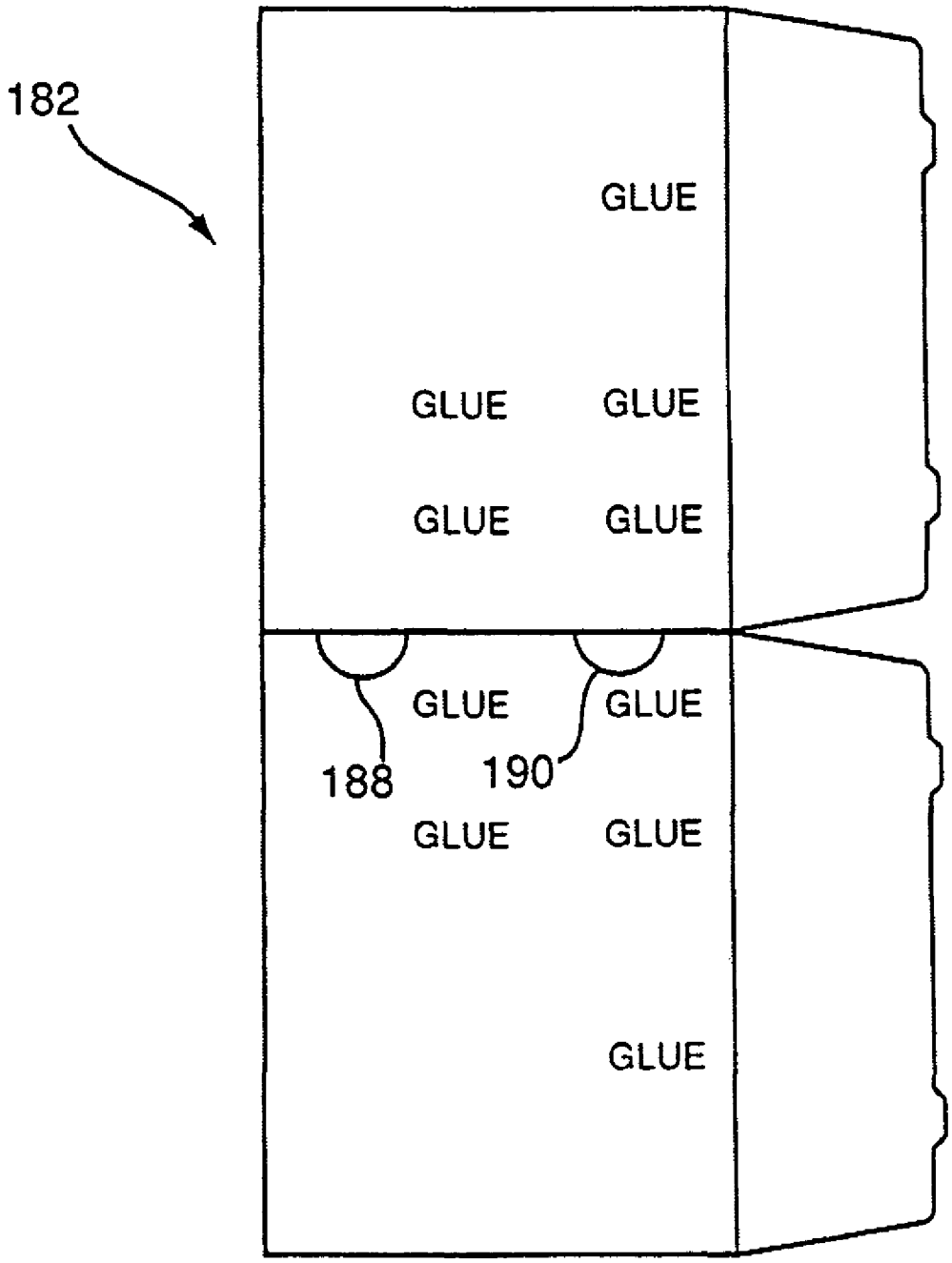
Figure 10:
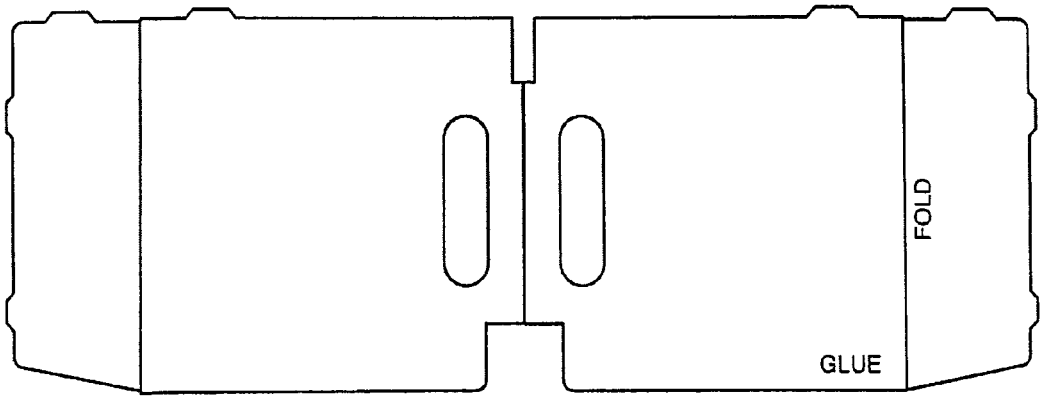
Figure 11:
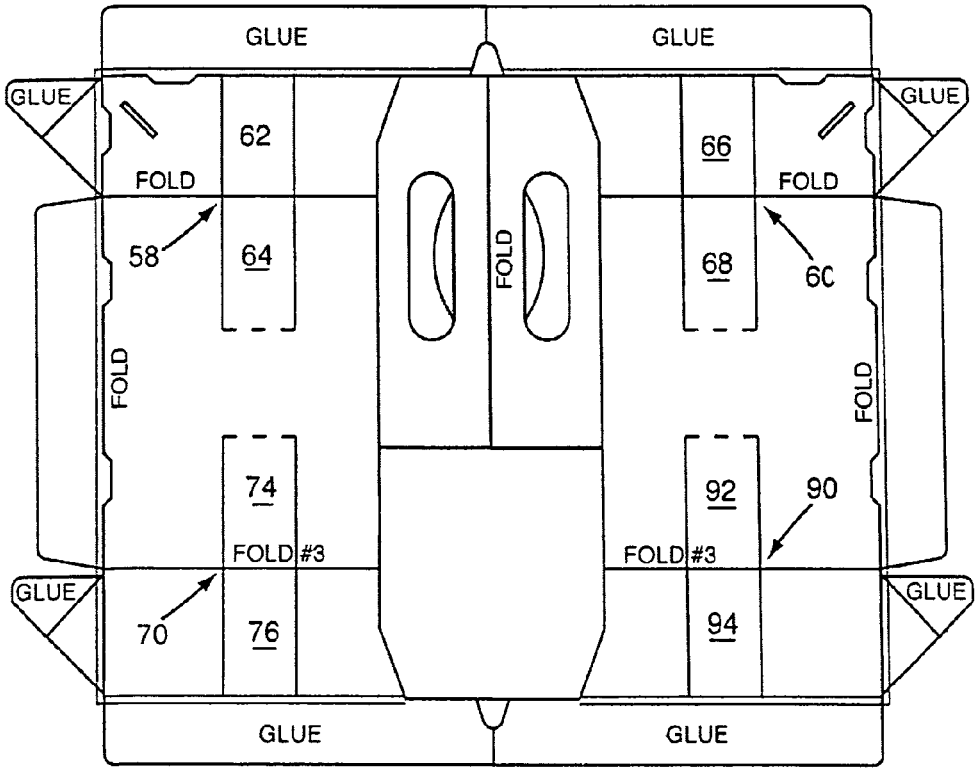

FIGS. 7 and 8 show blanks for one type of a two-piece six-pack carrier using the invention, and FIGS. 10 and 11 show blanks for another type of two-piece six-pack carrier using the invention.

Figure 9:
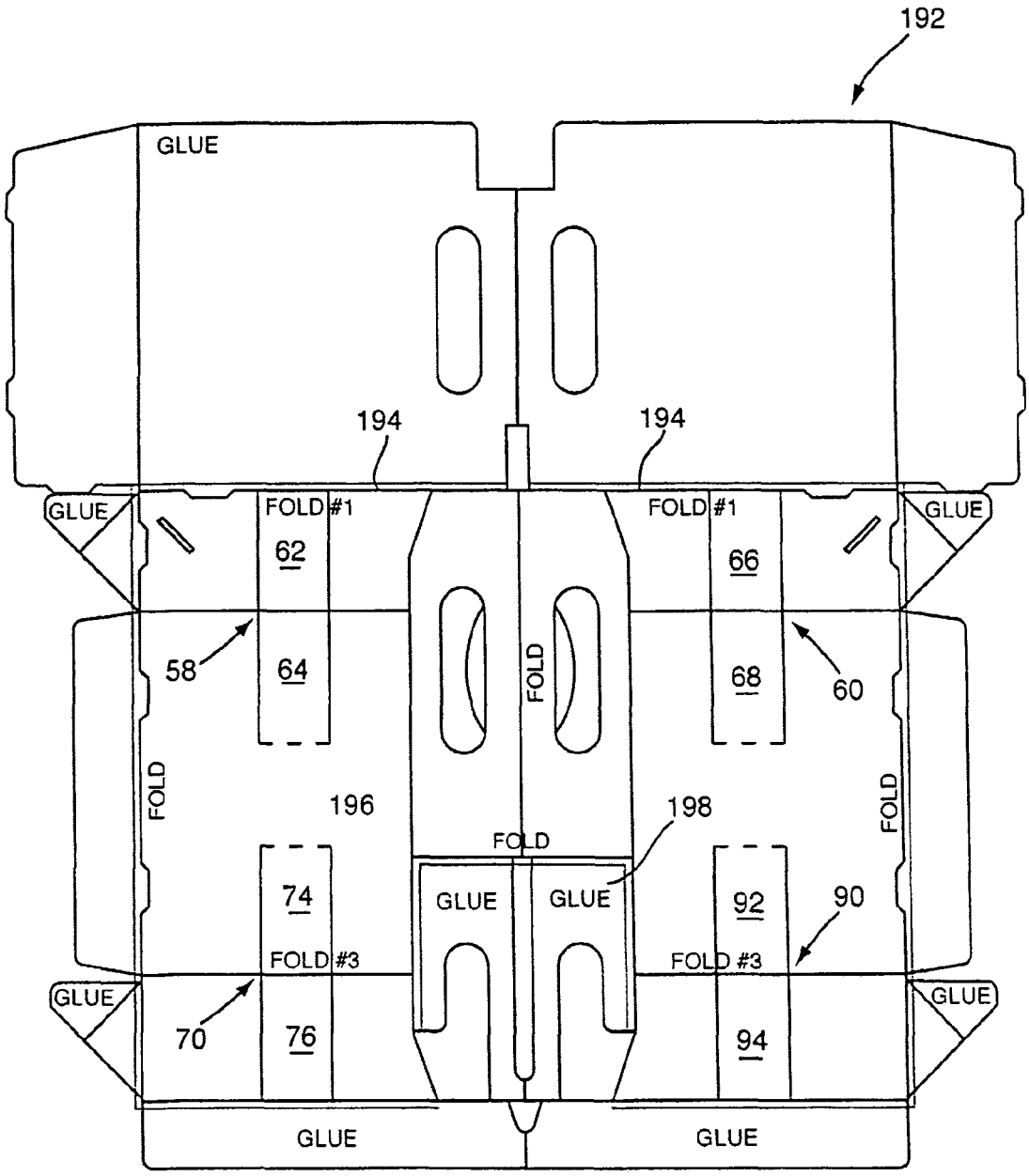

FIG. 9 shows the blank for another single-piece six-pack carrier, similar to that shown in FIGS. 1-4, which uses the invention.

The blank 180 of FIG. 7 forms the side walls and the majority of the bottom walls of a carrier when assembled with a blank 180 shown in FIG. 8 forming the central support structure for the carrier when joined with the blank 180.

As it is explained in greater detail, with reference to FIGS. 3 and 4 of patent application Ser. No. 11/345,898, filed Feb. 2, 2006 (the "'898 application"), the blank 182 of FIG. 8 can be made of less expensive material than the blank 180 to reduce the cost of the carrier without degrading the load-carrying capabilities of the carrier.

The only significant differences between the carrier and the blanks shown in FIGS. 7 and 8 and that shown in FIGS. 3 and 4 of the '898 application is that the divider structures 58, 60, 70 and 90 replace the divider structures shown in the pending patent application. The divider structures are used in the same way as the embodiment of FIGS. 1-4.

Other differences are that there are two small tabs 188, 190 in FIG. 8 to serve the same purpose as the single large tab 77 of FIG. 4 of the '898 application, and two panels 184 and 186 have been added in FIG. 7 to further reinforce the handle structure of the carrier.

Because the carrier shown in FIGS. 7 and 8 otherwise functions in the same way as the one shown in FIGS. 3 and 4 of the '898 application, the description of the manufacture and use of the latter carrier is incorporated by reference herein without further detailed description of the FIGS. 7-8 embodiment of this invention.

The two-piece embodiment of FIG. 10-11 is essentially the same as that of FIGS. 8-9 of the '898 application, except that the divider structures 58, 60, 70 and 90 are substituted for the divider structure of the carrier shown in FIGS. 8-9 of the '898 application, the description of which hereby is incorporated herein by reference.

The one-piece embodiment of FIG. 9 is essentially the same as the two-piece embodiment of FIGS. 10-11 except that the vertical support structure 192 of FIG. 9 is made of the same material as that of the rest of the carrier, and is attached to the remainder of the blank along a fold line 194. In addition, a pair of handle reinforcement panels 196 and 198 is provided to strengthen the handle structure.

It is possible to form divider structures using a pair of cut horizontal strips, one vertically above the other, and selectively using the strips to give greater variability to the depth of the compartments, or for other purposes. In fact, the strips of side wall above the divider structures 58, 70, etc., can be folded inwardly and used as a second set of dividers, if desired.

Although it is preferred to provide two receptacles each with its own separate automatic folding and unfolding bottom structure as described above, it is possible to replace that bottom structure with a conventional sling bottom, when the carriers are to be pre-filled at a bottling plant with a predetermined number of beverage cans or bottles of a predetermined size. The claims of this patent application are intended to cover the use of such a bottom structure as well as any equivalent bottom structure, unless it is specifically stated to the contrary therein.

The above description of the invention is intended to be illustrative and not limiting. Various changes or modifications in the embodiments described may occur to those skilled in the art. These can be made without departing from the spirit or scope of the invention.

What is claimed is:

1. A carrier having a vertical support panel structure, a pair of foldable receptacles, each extending outwardly from and secured to said vertical support panel structure, each of said receptacles having a plurality of side walls and a separate foldable bottom wall structure secured to said side walls, said side walls including a first side wall which, when unfolded, extends away from said vertical support panel structure and which is linked along a vertical fold line to a second side wall which extends substantially parallel to and spaced from said vertical support panel structure when unfolded, said first and second side walls having at least two vertically-spaced horizontal parts, one of said parts having first and second sections, said first section extending from said vertical support panel along said first side wall to said fold line, and said second section extending from said fold line along said second wall to a distance from said fold line substantially equal to the distance of said second wall from said vertical support panel structure, and in which each of said receptacles has four of said side walls, and said bottom wall structure includes a flange extending outwardly from the lower edge of each of said side walls and being linked to said side wall along a fold line, adjacent ones of said flanges being secured to one another and the ones of said flanges located in two opposite corners of said bottom wall structure being folded along diagonal fold lines.

2. A carrier as in claim 1 in which each of said receptacles includes a third side wall linked to said second side wall along a second vertical fold line and extending outwardly from said vertical support panel structure when unfolded, said second and third side walls having at least two vertically-spaced horizontal parts, one of said parts having first and second sections, said first section extending along said third wall from said vertical support panel structure to said second vertical fold line, and along said second wall from said second fold line to a distance from said second fold line substantially equal to the distance of said second wall from said vertical support panel structure.

3. A carrier as in claim 1 in which said one horizontal part is folded inwardly when said carrier is unfolded so that said second section forms a divider for said receptacle.

4. A carrier as in claim 1 in which said one horizontal part forms at least a portion of the upper edge of each of said first and second side walls, whereby said one part can be folded inwardly to form a divider for said receptacle, and to reduce the heights of said first and second side walls.

5. A carrier as in claim 1 in which said vertical support panel structure includes a pair of panels secured together, the lower portion of each forming one of the side walls of one of said receptacles, each of said panels having a handle hole in its upper portion.

6. A carrier as in claim 1 in which one of said flanges extends a substantial portion of the distance across said bottom wall structure and is positioned, during unfolding of said carrier, so that one of its side edges bears against one of said side walls so as to hold said receptacle open to receive objects to be carried.

7. A carrier having a vertical support panel structure, a pair of foldable receptacles, each extending outwardly from and secured to said vertical support panel structure, each of said receptacles having a plurality of side walls and a foldable bottom wall structure secured to said side walls, said side walls including a first side wall which, when unfolded, extends away from said vertical support panel structure and which is linked along a vertical fold line to a second side wall which extends substantially parallel to and spaced from said vertical support panel structure when unfolded, said first and second side walls having at least two vertically-spaced horizontal parts, one of said parts having first and second sections, said first section extending from said vertical support panel along said first side wall to said fold line, and said second section extending from said fold line along said second wall to a distance from said fold line substantially equal to the distance of said second wall from said vertical support panel structure, in which each of said receptacles has four of said side walls, and said bottom wall structure includes a flange extending outwardly from the lower edge of each of said side walls and being linked to said side wall along a fold line, adjacent ones of said flanges being secured to one another and the ones of said flanges located in two opposite corners of said bottom wall structure being folded along diagonal fold lines, in which one of said flanges extends a substantial portion of the distance across said bottom wall structure and is positioned, during unfolding of said carrier, so that one of its side edges bears against one of said side walls so as to hold said receptacle open to receive objects to be carrier, and in which said one flange has a tab extending from said side edge and said one side wall has a slot positioned to receive said tab when said bottom wall structure is partially unfolded.

8. A carrier having a vertical support panel structure, a pair of foldable receptacles, each extending outwardly from and secured to said vertical support panel structure, each of said receptacles having a plurality of side walls and a foldable bottom wall structure secured to said side walls, said side walls including a first side wall which, when unfolded, extends away from said vertical support panel structure and which is linked along a vertical fold line to a second side wall which extends substantially parallel to and spaced from said vertical support panel structure when unfolded, said first and second side walls having at least two vertically-spaced horizontal parts, one of said parts having first and second sections, said first section extending from said vertical support panel along said first side wall to said fold line, and said second section extending from said fold line along said second wall to a distance from said fold line substantially equal to the distance of said second wall from said vertical support panel structure, in which each of said receptacles has four of said side walls, and said bottom wall structure includes a flange extending outwardly from the lower edge of each of said side walls and being linked to said side wall along a fold line, adjacent ones of said flanges being secured to one another and the ones of said flanges located in two opposite corners of said bottom wall structure being folded along diagonal fold lines, in which one of said flanges extends a substantial portion of the distance across said bottom wall structure and is positioned, during unfolding of said carrier, so that one of its side edges bears against one of said side walls so as to hold said receptacle open to receive objects to be carrier, and in which said one flange extends completely across said bottom wall structure and has at least one tab extending outwardly from one edge in a direction perpendicular to said vertical support panel structure, and a slot in the one of said side walls towards which it extends to receive said tab to hold said one flange in place.

9. A carrier as in claim 1 in which each of said vertically spaced parts is folded along said fold line when said carrier is folded, the upper part being folded inwardly to form a folded divider, and the other of said vertically spaced parts being folded outwardly to form said first and second side walls when said carrier is unfolded.

10. A method of erecting a folded carrier to receive objects to be carried, said carrier comprising a vertical support panel structure, a pair of foldable receptacles, each extending outwardly from and secured to said vertical support panel structure, each of said receptacles having a plurality of side walls and a foldable bottom wall structure secured to said side walls, said side walls including a first side wall which when unfolded, extends away from said vertical support panel structure and which is linked along a vertical fold line to a second side wall which extends substantially parallel to and spaced from said vertical support panel structure when unfolded, said first and second side walls having at least two vertically-spaced horizontal parts, one of said parts having first and second sections, said first section extending from said vertical support panel along said first side wall to said fold line, and said second section extending from said fold line along said second wall to a distance from said fold line substantially equal to the distance of said second wall from said vertical support panel structure, comprising the step of unfolding said carrier by pushing opposite side edges of the folded carrier towards one another, and selectively performing a further step selected from the group consisting of:

(a) pushing said one part to fold it inwardly during or after unfolding said carrier;

(b) aligning the two sections of said one part in the same plane with one another when said carrier is folded, and placing a barrier to block the outward bending of said upper part during unfolding;

(c) aligning the two sections of said one part in the same plane with one another when said carrier is folded, and leaving secured to said vertical support panel structure the first section of said one part when folding said carrier; and (d) folding said upper part inwardly at the edge of the folded carrier at which said second side wall is folded over onto said first side wall.

11. A method as in claim 10 in which each of said receptacles has four of said side walls, and said bottom wall structure includes a flange extending outwardly from the lower edge of each of said side walls and being linked to said side wall along a fold line, adjacent ones of said flanges being secured to one another and the ones of said flanges located in two opposite corners of said bottom wall structure being folded along diagonal fold lines, in which one of said flanges extends a substantial portion of the distance across said bottom wall structure and is positioned, during unfolding of said carrier, so that one of its side edges bears against one of said side walls so as to hold said receptacle open to receive objects to be carried, including the step of using automatic filling equipment to fill said receptacles with beverage containers.

12. A carrier as in claim 1 in which each of said first and second sidewalls is separated into at least three vertically disposed parts, an upper part, a lower part, and an intermediate part, said one part being said intermediate part.

* * * * *